United States Patent [19]

Shinneman

[11] 4,453,447

[45] Jun. 12, 1984

[54] PERCUSSION INSTRUMENTS BOW

[76] Inventor: Leonice L. Shinneman, 1234 Skeel Dr., Camarillo, Calif. 93011

[21] Appl. No.: 429,216

[22] Filed: Sep. 30, 1982

[51] Int. Cl.[3] ..... G10D 13/00

[52] U.S. Cl. ..... 84/422 S; 84/282

[58] Field of Search ..... 84/282, 415, 422 S

[56] References Cited

U.S. PATENT DOCUMENTS

| | | | |
|---|---|---|---|
| 564,091 | 7/1896 | Loppentien | 84/282 |
| 2,258,998 | 10/1941 | Nebel | 84/282 |
| 3,545,330 | 12/1970 | Nosco | 84/282 |
| 4,383,467 | 5/1983 | Glassford | 84/415 |

FOREIGN PATENT DOCUMENTS

| | | | |
|---|---|---|---|
| 364771 | 12/1929 | Fed. Rep. of Germany | 84/282 |
| 470525 | 4/1952 | Italy | 84/282 |

*Primary Examiner*—Lawrence R. Franklin

*Attorney, Agent, or Firm*—Michael L. Harrison

[57] ABSTRACT

A device for playing percussion instruments by striking or bowing a free accessible edge comprises an arcuate handle having a web of high coefficient of friction material stretched across the chord of the arc, and a mallet affixed to one end. A tensioning device on the end opposite the mallet provides for adjustments and maintenance of the tension of the web.

5 Claims, 10 Drawing Figures

PERCUSSION INSTRUMENTS BOW

BACKGROUND OF THE INVENTION

1. Field of the Invention

The present invention relates to the field of musical instruments and in particular to devices for playing percussion instruments such as xylophones, vibraphones, marimbas, cymbals and the like, which instruments have a surface and an accessible free edge.

2. Prior Art

In the past, novelty and variety of musical sounds have been created by an ever-increasing array of specialized and exotic musical devices as well as implements for playing those devices. In particular, percussion instruments and accessories of all varieties and in all size ranges have proliferated over the course of music history.

For high-level musical ensembles, it is expected that professional percussionists will exhibit virtuousity in both the traditional percussion instruments, such as drums and cymbals and the like, and in the performance of chromatic, melodic passages on instruments having full chromatic capabilities such as xylophones, marimbas, and the like.

Studio musicians in particular are required to exhibit sufficient versatility and accomplishment to play technically complex melodic passages, and music having melodic passages is frequently encountered in the professional's playing environment. Due to the demand for variety which is placed on the modern day percussionists, and due to the costs of production in the music industry, exotic and special effects are increasingly the responsibility of fewer and fewer individuals. The demand for novelty in recorded sound also requires a wide range of talents, especially from percussionists.

A variety of mechanical devices have heretofore been devised to assist percussionists in the performance of these tasks, including both new implements for playing the instruments, and new methods of holding or operating both the new and the old implements. In addition, new percussion instruments have been proposed as well.

A recent innovation in the performance of percussion passages is a technique which employs bows, of the type usually employed by string players, to produce a continuous sound from an instrument which is otherwise normally struck by a stick or mallet. The bow is brought into contact with the free edge of a percussion device, such as a xylophone bar or the edge of a cymbal, and is caused to pass along the edge of the device thereby causing it to be continuously sounded at its natural resonance frequencies. For those instruments which have a single resonance, such as the bars of xylophones, vibraphones, marimbas, and the like, the result is a continuous tone the magnitude of which is determined by the amount of pressure and the speed with which the bow is drawn across the edge of the bar.

For instruments having no distinct resonant frequency, such as cymbals and the like, bowing produces a unique and completely different sound comprised of the complex resonances of the instrument within the vicinity of the bowed edge. The effect thus obtained is not reproducible, however, by any other percussionist's implements regardless of how skilled the player may be.

Frequently in the performance of a musical score, percussionists are required to produce, rapidly in alternation, both bowed and struck sound effects, which effects require either two or more persons since such a rapid change of playing implements would render the passage technically impossible for a single player using conventional implements.

SUMMARY OF THE INVENTION

Accordingly, a need exists for a device for playing percussion instruments, which device may be rapidly alternated between use as a percussive mallet and a bow. The present invention provides this objective by providing a lightweight, at least partially arcuate handle, stretched between the two ends of which is a thin web of an appropriate substance having a high coefficient of friction with the surface of the instrument which is being played. At one end of the handle is a tensioning device which may be adjusted to cause the web to be either loosened or tightened, providing varying degrees of tension, as best suited to the characteristics of the instrument being played. At the other end of the bow, and adapted to the bow such that it protrudes from the extreme end of the bow, is a spheroidally-shaped striking surface, adapted to produce the desired percussive effect when the surface of the percussive instrument is struck.

These features and others of the present invention are shown in the following text and in the drawings in which:

DESCRIPTION OF THE PREFERRED EMBODIMENT

Figure 1:
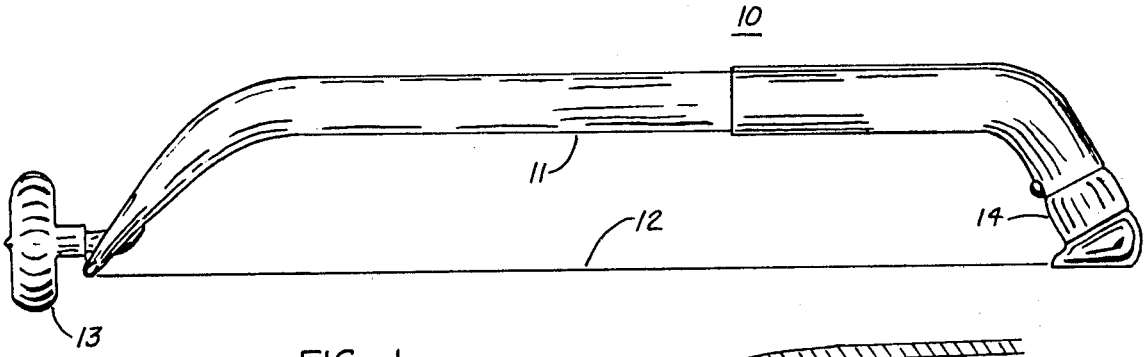
FIG. 1 is a side view of a percussionist's bow having a simple tensioning device and a striking implement in accordance with the present invention.

Referring now to FIG. 1, there is shown a side view of the percussionist's bow 10 in accordance with the present invention. In FIG. 1, the principal parts of the bow are the handle 11, the web 12, the mallet 13, and tensioning components 14. The handle may be manufactured of any strong light-weight material which is capable of being formed into the desired slightly arcuate shape. It is preferred that the handle be easily grasped, generally at the end where the tensioning device is located, so that the webbing 12 may be drawn across the edge of the instrument, or so that the mallet 13 may be used to strike the instrument.

A sufficient clearance between the handle 11 and the web 12 can be provided by making the clearance as small as even one centimeter or less. However, to allow easy facility in holding the handle, it is preferred that the webbing to handle clearance be on the order of 2 or 3 centimeters or greater.

Figure 2:
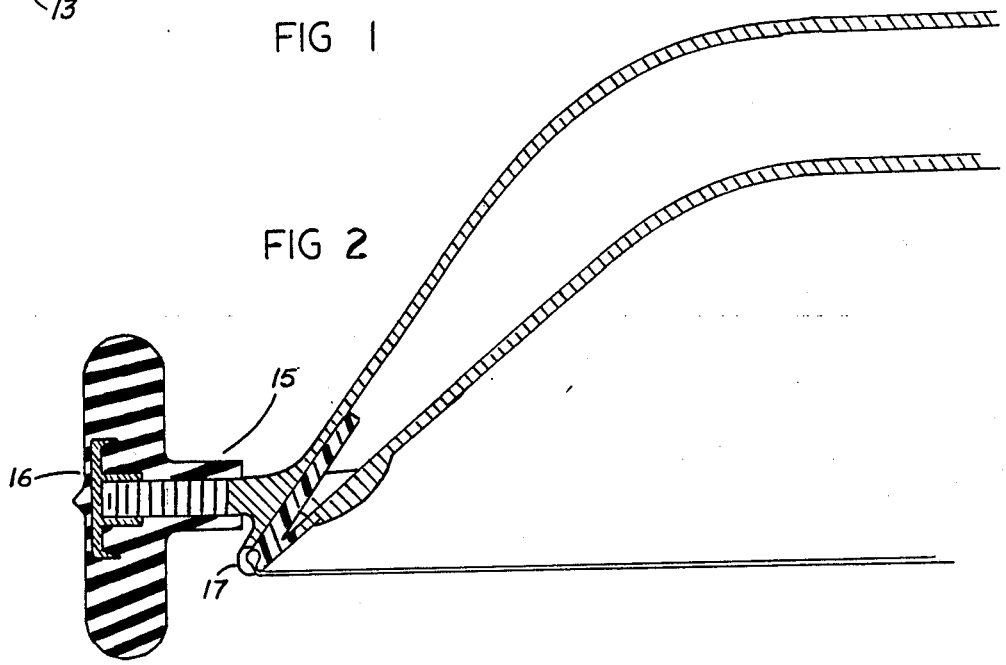
FIG. 2 is a cross-sectional, detailed side view of the striking portion of the bow showing a threaded insert and the matching threaded rod for interchangeability of mallets.

The mallet 13 may be manufactured of any material having suitable hardness and resiliance to produce the desired percussive effects when the mallet is struck upon the surface of the instrument. A different hardness and resiliance may be desired, for example, to play marimbas, as opposed to xylophones. And a different hardness and resiliance still may be desired to produce the expected sound effects on a cymbal. For most uses, and for average players, the mallet head will be chosen to be relatively soft vinyl or equivalent may be employed having an approximate range of 30–90 Durometer hardness. Rigid plastics, wood, felt and various combinations of overlaying felt or yarn material may also be employed for varying effects. In the preferred embodiment the mallet is interchangeable, as shown in FIG. 2, by means of engagement of a threaded shaft 15 with a threaded shaft insert 16 which is installed in the mallet end of the bow.

The webbing 12 is retained at the mallet end by swaging the webbing into a slotted cylindrical hollow 17 which thereby engages a thickened portion of the webbing. The edges of the hollow 17 are preferably deburred or rounded to prevent sharp edges from being in contact with the webbing in the vicinity of the mallet end.

The webbing 12 itself is comprised of a plurality of strands of suitable material for creation of a high coefficient of friction with the edge of the instrument being played. Traditional materials such as horsehair may be employed, however, a more suitable, and the preferred material is composed of a plurality of strands of monofilament Nylon having a diameter equivalent to approximately a 12 pound test line.

The webbing 12 material in its original condition is too smooth to have the desired high coefficient of friction. Accordingly, it is treated to roughen its surface by means of abrasion of the strands with a fine abrasive. Chemical etching may also be employed.

Following the roughening, the user may load the surface of the strands with a material such as resin to further enhance its friction. The roughening followed by resin-loading thus produces a very high coefficient of friction with all surfaces of interest to a percussionist.

Figure 4:
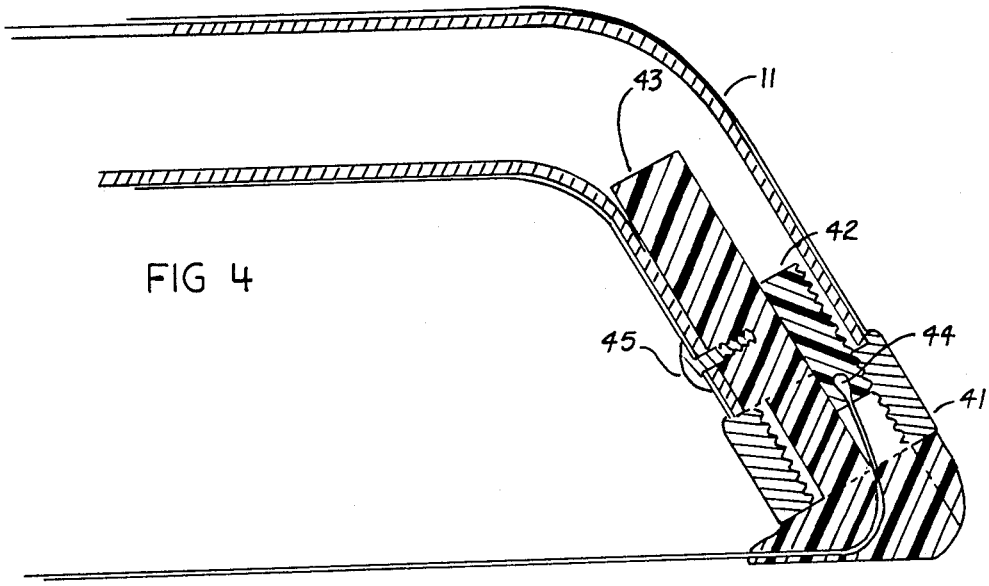
FIG. 4 is a detailed, enlarged view of the tensioning device shown in FIG. 1.

Referring now to FIG. 4, there is shown a cross-sectional side view of a tensioning device 14 in accordance with the present invention. Adjustment nut 41 is internally threaded with a thread configuration having a very low pitch in order to afford maximum adjustability and to minimize the tendency to gradually lose adjustment. Tensioning block 42 is a portion of a threaded cylinder having an external thread configuration adapted to that of the internal thread of adjustment nut 41. Tensioning block 42 is restrained against rotation and is caused to slide within the confines of a semi-circularly shaped slot formed by the inside dimension of the handle 11 and a semi-circularly shaped spacer 43. Spacer 43 is in turn held in place by screw 45.

Tensioning block 42 is preferably attached to web 12 by means of a slotted cylindrical hollow 44 which is adapted to be swaged to fit a slightly enlarged cylindrically shaped portion at the end of the web 12.

Figure 5:
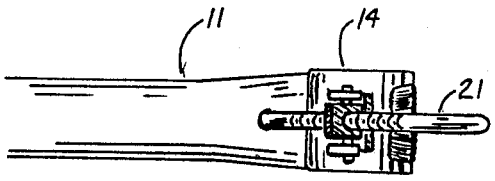
FIG. 5 is a top view of a first alternative tensioning device.
Figure 6:
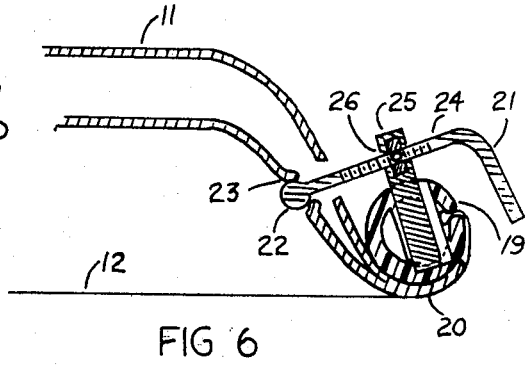
FIG. 6 is a cross-sectional side view of the first alternative tensioning device shown in FIG. 5.

In FIG. 5 and FIG. 6 are shown an alternative version of a tensioning device 14 consisting of a small cylinder 19 which is adapted to fit the curve provided by the curved area 20 of the handle 11. Adjusting screw 21 has an "L"-shaped portion whereby the screw may be rotated by finger pressure, and an enlarged head end 22 which engages the handle by means of pressure, against the circumference of the tensioning aperture 23. Tensioning screw 21 is threaded along at least a portion of its length, with the threaded portion 24 engaging the mating threads of the adjustment nut 25 which in turn applies force to the circumference of the cylinder 19 by means of lever arm 26. Since force is exerted toward the frame by the adjustment screw 21 on one side of the cylinder 19 and tension of the web 12 on the opposite side of the cylinder 19 exerts a balancing force against the frame, cylinder 19 is automatically maintained within its position within the curved portion 20 of the handle 11.

Figure 7:
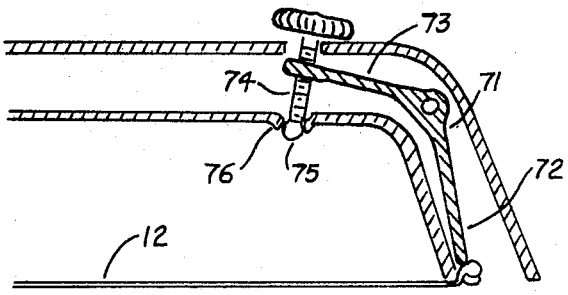
FIG. 7 is a cross-sectional side view of a second alternative tensioning device.

Referring now to FIG. 7, there is shown a cross-sectional side view of a second alternative tensioning device in accordance with the present invention. Lever 71 is pivoted near the curve of the handle 11 and has two arms extending through the handle. The first arm 72 is attached to the web 12 by suitable means. The second arm 73 extends into the linear portion of the handle and has a threaded portion which engages the matching threads of an adjusting screw 74. Adjusting screw 74 is retained in place and is restrained against movement by means of a enlarged end 75 which engages the sides of an aperture 76 in the lower side of the handle. Turning adjustment screw 74 causes movement of arm 73 which in turn causes movement of arm 72, causing web 12 to be tightened or loosened as is required.

Other variants of the lever arrangement may of course be devised with the pivot and fulcrum being interchanged, as is well known. The lever may also be straight and contained entirely within the confines of the portion of the handle between the curve and its end.

Figure 8:
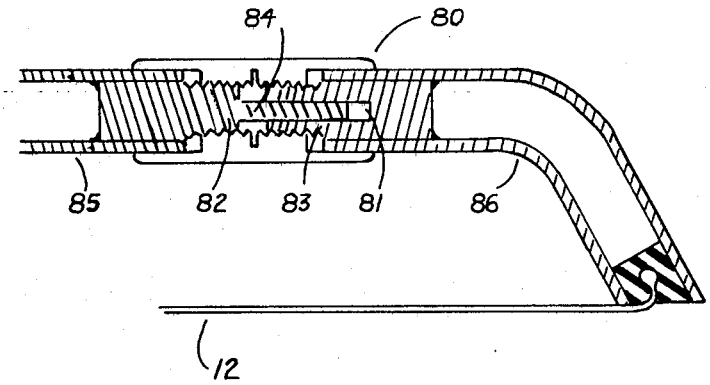
FIG. 8 is a cross-sectional side view of a third alternative tensioning device.

Referring now to FIG. 8, there is shown a cross-sectional side view of a third alternative tensioning device in accordance with the present invention.

Threaded members 82 and 83 are reversed-pitched and engage complementary threads on the interior of adjustment nut 80. Each threaded member 82 and 83 respectively is attached to one portion of the handle by any suitable means or may be integrally formed with the handle. Thus, threaded member 82 attaches to the mallet end of the handle 85, while thread 83 attaches to the opposite end 86. Adjustment of the webbing tension is accomplished by rotating the adjustment nut 80 with respect to the handles. Alignment of the handles is maintained by the engagement of alignment pin 84 with a matching cavity 81. Both lineal and axial alignments are maintained by giving the pin and cavity a non-circular cross-section, preferably a square or triangular shape for simplicity.

Figure 9:
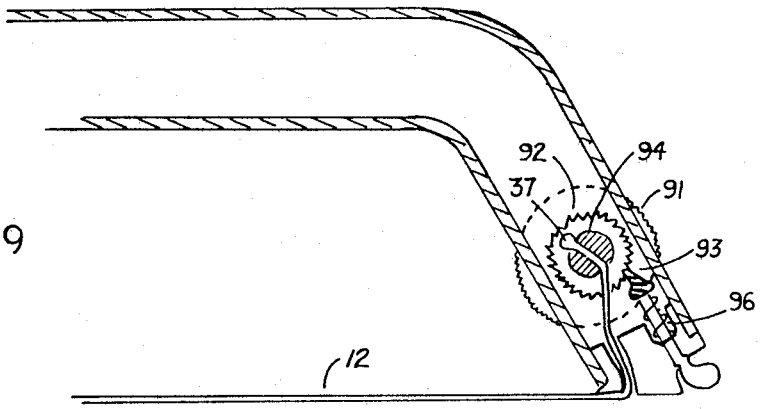
FIG. 9 is a cross-sectional side view of a fourth alternative tensioning device.

In FIG. 9, there is shown a fourth alternative tensioning device in accordance with the present invention. The webbing 12 is maintained taut by spooling it around axle 94, which is slotted to engage the cylindrically-shaped enlarged end 37 of the webbing. Tightening is achieved by rotation of the axle 94 by means of thumbwheel 91. When the desired tension is achieved, the axle 94 position is maintained by the action of ratchet 92 and its engagement with pawl 93. The pawl is in turn maintained in position against the ratchet by means of spring pressure exerted by spring 96. To loosen the tension, the pawl 93 is backed away from the ratchet 92 by means of grip 95, thereby allowing the axle 94 to turn freely.

Figure 3:
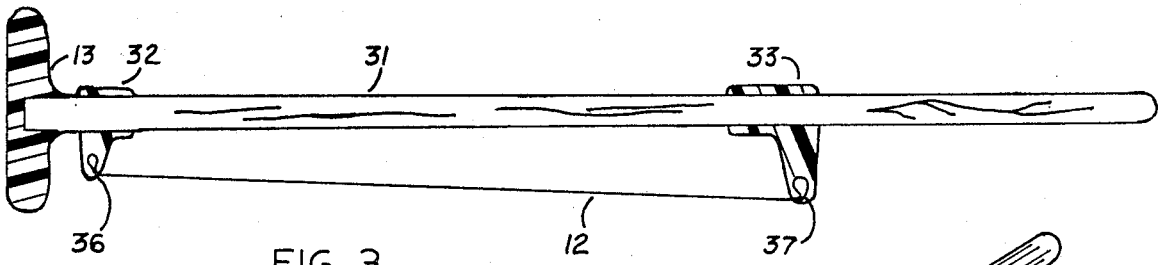
FIG. 3 is a side view of a percussionist's bow having a simplified structure and a simplified tensioning device in accordance with the present invention.
Figure 10:
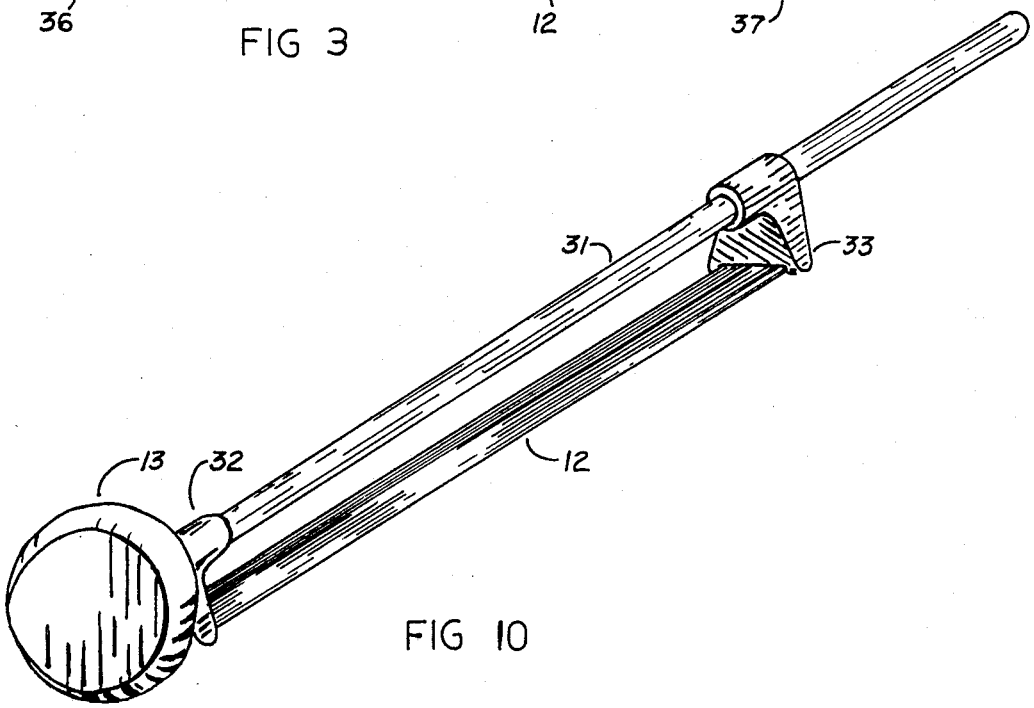
FIG. 10 is an oblique side view of the percussionist's bow of FIG. 3.

Referring now to FIGS. 3 and 10, there is shown a simpler version of a percussionist's bow 30 similar in overall form to that of FIGS. 1 and 2, and 4 through 9, but employing a tensioning device of less complexity. The mallet 13 is fixedly attached to a handle 31 upon which are mounted two halves of a simple tensioning device consisting of tensioning blocks 32 and 33, suspended between which is the web 12. The tensioning blocks 32 and 33 are simple blocks having, on at least one side, a shape adapted to spread the web uniformly across a flat surface, and having a mounting hole which is a close, snug fit to the shaft 30. The tension provided by the web 12 tends to maintain both mounting blocks 32 and 33 in a slightly angled position with respect to the shaft 31 so that that force exerted by the edges of their mounting holes causes a high coefficient of friction to exist between the inside bore on the mounting holes and shaft 30. Thus the web is maintained in a fixed tension until the blocks are released. To apply tension, the blocks are held in position and in an approximate alignment with the shaft so that their center holes are maintained in alignment with shaft 30 and are forced in opposite directions until the desired tension exists on the web 12. The blocks are then allowed to resume their natural position thereby binding upon the shaft 30 and causing their tension to be maintained until released as noted above. In the preferred embodiment, the tensioning blocks have an elongated mounting hole which provides greater frictional forces against the shaft 31. Attachment of the tensioning blocks 32 and 33 is preferably by means of slotted cylindrical cavities 36 and 37 which are swaged to engage the enlarged ends of the web 12. The mallet 13 may, as before, be manufactured of any material having suitable hardness and resiliance to produce the desired percussive effect.

The handle 30 may be manufactured of any material having strength sufficient to withstand the pressures exerted by the web 12 on the mounting blocks 32 and 33 without excessive deformation or breakage of the handle 30.

All of the mallets described are employed in the same way. In use, the percussionist grips the handle at the end opposite the mallet and may use it as a conventional mallet for striking the surface of a percussion instrument. When continuous tones or sound effects are required, however, the web 12 is brought into contact with the edge of the instrument being played by angling the handle with respect to the surface of the instrument and resting the web 12 upon the edge. The bow is then moved with respect to the edge of the instrument, thereby producing extremely rapid alternating engagement and disengagement of the edge of the instrument with the web. If the instrument is one of the family of instrument having a natural resonant frequency such as the bars the xylophone produces, the bow produces a continuous, sound at the characteristic resonance frequency. The amplitude of the tone thus produced may be increased by increasing the pressure of the web against the instrument or by increasing the speed with which the bow is drawn across the edge.

For those instruments within the family of instruments having no simple natural resonance, such as cymbals and the like, the bow produces a continuous sound having the characteristic tones of the instrument but absent the large transient which characterize the instrument when it is played by normal percussion techniques. The characteristic sound is that of the complex tones produced by exciting the complex resonances of the instrument within the vicinity of the bowed edge. The effect produced is unlike any sound which can be produced by conventional percussionist's implements regardless of the skill of the player.

It will be appreciated by those skilled in the art that variations of the device described in the preferred embodiment may be practiced without departure being made from the principles of the present invention, and that each of these variations will be practiced within the scope of the invention which is defined or set forth in the following claims:

What is claimed is:

1. A device for producing sounds on a percussion instrument comprising:

an elongated at least partially arcuate handle, having a first and second end;

a web of a material having a relatively high coefficient of friction with the edge of a percussion instrument, the first end of which is attached to the first end of the handle;

tensioning means, adapted to the second end of the handle and attached to the second end of the web, such that the web can be brought into tension against the handle across the chord of the arc;

mallet means, attached to the first end of the handle, for striking surfaces of percussion instruments.

2. A device for producing percussion instrument sounds, comprising:

an elongated handle;

a first and a second tensioning block having apertures which slightly clear the dimensions of the handle so that the tensioning blocks snugly but slideably fit the handle;

a web of material having a relatively high coefficient of friction with the surface of a percussion instrument, one end of which is affixed to the first tensioning block, the other end of which is affixed to the second tensioning block;

mallet means, attached to one end of the handle, for striking surfaces of percussion instruments.

3. The apparatus of claim 1 or claim 2 in which the web material is stranded, monofilament nylon having a plurality of strands of approximately twelve-pound test monofilament nylon.

4. The apparatus of claim or claim 2 in which the mallet is interchangeable.

5. The apparatus of claim 4 in which the interchangeable mallet is a mallet head mounted upon a first threaded fastener and the first end of the handle is fitted with a second threaded fastener having threading which mates with the threading of the first threaded fastener.

* * * * *